US009399570B2

(12) United States Patent
van Haperen et al.

(10) Patent No.: US 9,399,570 B2
(45) Date of Patent: Jul. 26, 2016

(54) BEVERAGE DISPENSER WITH WATER COOLER AND CONCENTRATE ADDING DEVICE

(75) Inventors: Bartholomeus Johannes Antonius van Haperen, Vlaardingen (NL); Posan Pang, Datchet (GB); Miles Richard Macintosh Pennington, Teddington (GB); Jonkheer Theodoor Hendrik van de Poll, Vlaardingen (NL); Anthony Edward Quinn, Sharnbrook (GB); James Matthew Slater, Paris (FR)

(73) Assignee: Conopco, Inc., Englewood Cliffs, NJ (US)

( * ) Notice: Subject to any disclaimer, the term of this patent is extended or adjusted under 35 U.S.C. 154(b) by 581 days.

(21) Appl. No.: 13/516,777

(22) PCT Filed: Nov. 29, 2010

(86) PCT No.: PCT/EP2010/068397

§ 371 (c)(1),
(2), (4) Date: Oct. 2, 2012

(87) PCT Pub. No.: WO2011/076520

PCT Pub. Date: Jun. 30, 2011

(65) Prior Publication Data

US 2013/0042941 A1 Feb. 21, 2013

(30) Foreign Application Priority Data

Dec. 22, 2009 (EP) ..... 09180292

(51) Int. Cl.
*B67D 3/00* (2006.01)
*B67D 1/00* (2006.01)

(52) U.S. Cl.
CPC ..... *B67D 3/0029* (2013.01); *B67D 1/0051* (2013.01); *B67D 3/0009* (2013.01); (Continued)

(58) Field of Classification Search
CPC .. B67D 1/0021; B67D 1/0051; B67D 3/0029; B67D 3/0032; B67D 3/0035; B67D 3/0054; B67D 3/0083
USPC ..... 141/82, 284, 352, 363–366, 375; 222/144.5, 129.1, 185.1
See application file for complete search history.

(56) References Cited

U.S. PATENT DOCUMENTS 3,688,950 A 9/1972 Parish
3,723,851 A * 3/1973 Johnson et al. ..... 222/132

(Continued)

FOREIGN PATENT DOCUMENTS

CA 2510733 A1 6/2005
EP 0736483 A1 10/1996

(Continued)

OTHER PUBLICATIONS

International Search Report, PCT/EP2010/068397, mailed Feb. 14, 2011, 4 pp.

(Continued)

*Primary Examiner* — Mark A Laurenzi
*Assistant Examiner* — Andrew StClair
(74) *Attorney, Agent, or Firm* — Ellen Plotkin

(57) ABSTRACT

A beverage dispenser (11) is disclosed for use in combination with a water cooler, wherein the water cooler comprises a cooling device (5) and a water bottle (1) and the beverage dispenser is intended to be positioned between the cooling device and the water bottle. The beverage dispenser comprises: a dispensing station (18), a dedicated water nozzle (17) for dispensing water at the dispensing station, a conduit (13) for supply of water from the water cooler to the water nozzle, a connector (22) for attachment to a container (12) comprising concentrate, a dedicated concentrate nozzle (16) for dispensing concentrate to the dispensing station, a conduit (23) for supply of concentrate from the container to the concentrate nozzle, and wherein the water nozzle and the concentrate nozzle are arranged such that water dispensed from the water nozzle and concentrate dispensed from the concentrate nozzle intersect, and wherein the angle (β) of the concentrate nozzle relative to the horizontal is from 25° to 90°, and the angle (α) of the water nozzle relative to the horizontal is from 45° to 90°.

5 Claims, 4 Drawing Sheets

(52) U.S. Cl.
CPC ..... *B67D3/0012* (2013.01); *B67D 3/0019* (2013.01); *B67D 3/0038* (2013.01); *Y10T 29/49716* (2015.01); *Y10T 29/53* (2015.01)

(56) References Cited

U.S. PATENT DOCUMENTS

| | | | | |
|---|---|---|---|---|
| 3,986,642 | A * | 10/1976 | Selvia et al. | 222/129.1 |
| 4,392,588 | A * | 7/1983 | Scalera | G07F 13/10 222/129.4 |
| 4,915,261 | A | 4/1990 | Strenger | |
| 5,003,790 | A * | 4/1991 | Goupil | 62/389 |
| 5,310,088 | A | 5/1994 | Burrows | |
| 5,758,571 | A | 6/1998 | Kateman et al. | |
| 6,073,539 | A | 6/2000 | Triola et al. | |
| 6,167,921 | B1 * | 1/2001 | Busick et al. | 141/18 |
| 6,286,564 | B1 * | 9/2001 | Wallace | 141/18 |
| 6,935,533 | B2 * | 8/2005 | Clausen et al. | 222/143 |
| 7,083,071 | B1 | 8/2006 | Crisp, III | |
| 7,328,818 | B2 * | 2/2008 | Prabucki | 222/146.6 |
| 7,651,008 | B2 | 1/2010 | Sher et al. | |
| 7,651,010 | B2 | 1/2010 | Orzech et al. | |
| 7,798,054 | B2 | 9/2010 | Evers et al. | |
| 2002/0040585 | A1 * | 4/2002 | Chaney | 62/237 |
| 2002/0129869 | A1 * | 9/2002 | Hydak et al. | 141/352 |
| 2002/0130140 | A1 * | 9/2002 | Cote | 222/129.1 |
| 2004/0112917 | A1 * | 6/2004 | Groesbeck | 222/105 |
| 2005/0121466 | A1 | 6/2005 | Sher et al. | |
| 2005/0133532 | A1 | 6/2005 | Crisp, III et al. | |
| 2006/0045942 | A1 * | 3/2006 | Sher | B67D 1/0021 426/115 |
| 2006/0249536 | A1 * | 11/2006 | Hartman et al. | 222/129.3 |
| 2007/0000949 | A1 * | 1/2007 | Bosi | 222/312 |
| 2007/0062972 | A1 | 3/2007 | Feldman et al. | |
| 2007/0272620 | A1 * | 11/2007 | Chaney | 210/748 |
| 2008/0041493 | A1 * | 2/2008 | Lin et al. | 141/353 |
| 2008/0148948 | A1 * | 6/2008 | Evers et al. | 99/275 |
| 2011/0215114 | A1 * | 9/2011 | Liccioni | 222/146.6 |
| 2011/0284585 | A1 * | 11/2011 | Stewart-Barnett | 222/189.06 |
| 2012/0326437 | A1 * | 12/2012 | Santos | 285/129.1 |
| 2013/0171320 | A1 * | 7/2013 | Scholvinck et al. | 426/590 |
| 2014/0239013 | A1 * | 8/2014 | Santos | 222/146.6 |

FOREIGN PATENT DOCUMENTS

| | | | |
|---|---|---|---|
| EP | 1806314 | A1 | 11/2007 |
| GB | 2256636 | A | 12/1992 |
| GB | 2403710 | | 1/2005 |
| JP | 07125798 | | 5/1995 |
| JP | 07137792 | | 5/1995 |
| JP | 09278092 | | 10/1997 |
| JP | 2007045496 | | 2/2007 |
| JP | 2011131936 | | 7/2011 |
| WO | WO9001449 | | 2/1990 |

OTHER PUBLICATIONS

EP Search Report, EP 09 18 0292, dated Jul. 9, 2010, 3 pp.
Search Report in EP09180297, Jul. 23, 2010.
Search Report in PCTEP2010068402, Feb. 21, 2011.
Written Opinion in EP09180292, Jul. 23, 2010.
Written Opinion in PCTEP2010068402, Feb. 21, 2011.
Written Opinion in EP09170297, Jul. 9, 2010.

* cited by examiner

BEVERAGE DISPENSER WITH WATER COOLER AND CONCENTRATE ADDING DEVICE

FIELD OF THE INVENTION

The present invention is in the field of beverage dispensers that are used in combination with water coolers. The invention also relates to a method for preparing a beverage, a method for modifying a water cooler, a water cooler and a kit for modification of a water cooler.

BACKGROUND OF THE INVENTION

Water coolers can be found in many offices and workplaces. Typically water coolers are provided for the supply of a fresh cup of cold or ambient water to a consumer. These water coolers generally consist of a cooler housing upon which a water bottle is put upside down. Usually the cooler housing contains a cooling device, a reservoir for cold water, and two water taps, for cold water and ambient water respectively. Part of the water from the bottle is cooled by the cooling device and temporarily stored in the reservoir prior to serving.

In general, in addition to water, the consumer may like to have a larger choice of beverages in order to quench his or her thirst. This would generally require that an additional beverage dispenser or a set of bottles containing, for example, fruit juice concentrates or syrups will be placed into the office. However, floor space is usually limited in offices, and additional dispensers are expensive and cost, in addition to space, a lot of energy for cooling. Therefore there is a need for cheap beverage dispensers which can be fitted to existing conventional water coolers, and with which beverages, in addition to water, can be supplied. Nowadays one of the beverages that is becoming more and more popular is ice tea, as this is a refreshing drink, containing healthy antioxidants and may contain less sugar than regular soft drinks.

A conventional way of making beverages in a dispenser is dilution of a concentrate with water. The concentrate is contained in a separate container, and after mixing a fixed amount of concentrate with a fixed amount of water, a ready to drink beverage is obtained.

Numerous types of beverage dispensers and water coolers are available on the market.

GB 2,403,710 discloses a dispenser for fruit concentrate in conjunction with a known water cooler. The dispenser comprises means into which a conventional concentrate bottle can be screwed by its neck whilst upright, then rotated to a vertical dispense position. The dispenser is attached to the side of a water cooler.

US 2005/0121466 discloses a device for dispensing a beverage comprising a mixture of liquid, e.g. water, and at least one liquid concentrate, comprising at least two liquid nozzles connected respectively to at least one liquid source for producing a first jet of liquid in air along first path and a second jet of liquid in air along a second path, at least one concentrate nozzle connected to at least one liquid concentrate source for delivering a stream of liquid concentrate in air along a third path, wherein the liquid nozzles and the concentrate nozzle are oriented with respect to each other so that the first, second and third paths intersect above a container at a common intersection point, whereby the mixture is formed by collision of the respective jets and the stream(s).

Furthermore, beverage mixers and dispensers which may use a conventional bottled water cabinet supporting a conventional bottle have been described.

For example, U.S. Pat. No. 3,723,851 discloses a beverage mixer and dispenser utilizing a bottled water holding cabinet which supports a water container and a plurality of flavor liquid containers; all of said containers being disposed for gravity-responsive delivery of liquids therefrom; and a dispensing and mixing valve below all of said containers; said valve having a rotatable and reciprocable valve member which may be rotated to any one of several selective positions communicating with any one of said flavor liquid containers; and said valve member may be reciprocably actuated against spring pressure to cause concurrent communication of said water container and one of said flavor liquid containers with a common outlet, of said valve, through which the water and a selected flavor liquid may be mixed and dispensed to a drinking receptacle.

Unfortunately the use of a common outlet to mix the flavour liquid and water as described in U.S. Pat. No. 3,723,851 may result in contamination of the dispensing valve with the final beverage which, unless complex cleaning means are included in the dispenser, may result in hygiene problems and/or carry-over of flavour from one type of beverage to another. We have recognised that including cleaning means in a dispenser for use with a water cooler would add unwanted complexity, weight, and cost thereto.

SUMMARY OF THE INVENTION

The object of the present invention is to provide a simple beverage dispenser that can easily be fitted to a conventional water cooler, therewith creating an extra choice of beverage for the consumer. Another object is to provide a beverage dispenser that is hygienic, in order to minimise cleaning requirements. A further object is to provide a beverage dispenser that dispenses a beverage into a cup without splashing.

It was found that one or more of these objects could be achieved by a beverage dispenser that is fitted to a conventional water cooler, by positioning it between the water bottle and the cooling device and which is provided with a specific configuration of the dispensing means.

In a first aspect the present invention provides a beverage dispenser for use in combination with a water cooler, wherein the water cooler comprises a cooling device and a water bottle, and the beverage dispenser is intended to be positioned between the cooling device and the water bottle, wherein the beverage dispenser comprises:

- a dispensing station,
- a dedicated water nozzle for dispensing water at the dispensing station,
- a conduit for supply of water from the water cooler to the water nozzle,
- a connector for attachment to a container comprising concentrate,
- a dedicated concentrate nozzle for dispensing concentrate at the dispensing station,
- a conduit for supply of concentrate from the container to the concentrate nozzle, and wherein the water nozzle and the concentrate nozzle are arranged such that water dispensed from the water nozzle and concentrate dispensed from the concentrate nozzle intersect, and wherein the angle ($\beta$) of the concentrate nozzle relative to the horizontal is from 25° to 90°, and the angle ($\beta$) of the water nozzle relative to the horizontal is from 45° to 90°.

In a second aspect the present invention provides a method of preparing and dispensing a beverage into a receptacle at the dispensing station of the dispenser of the first aspect, the method comprising dispensing a jet of water in air from the water nozzle and a jet of concentrate in air from the concentrate nozzle, wherein the jets are directed to intersect and mix in air before contacting the receptacle.

In another aspect, the present invention provides a method for modifying a water cooler using the beverage dispenser of the first aspect, the method comprising the following steps in any order:

positioning the dispenser between the cooling device and the water bottle;

arranging the conduit for supply of water to be in fluid communication with water in the water cooler, attaching the connector to the container to allow concentrate within the container to be in fluid communication with the conduit for supply of concentrate.

In a further aspect the present invention provides a water cooler, wherein the water cooler comprising a cooling device and a water bottle, and wherein the beverage dispenser of the first aspect is positioned between the cooling device and the water bottle.

In a still further aspect, the present invention provides a kit for modification of a water cooler, comprising the beverage dispenser of the first aspect, a conversion set, and written instructions on how to modify the water cooler with the beverage dispenser.

DETAILED DESCRIPTION OF THE INVENTION

The present invention provides one or more of the following advantages: The beverage dispenser can easily be fitted to an existing water cooler and gives the consumer an alternative choice of beverage. Moreover neither an additional beverage dispensing machine nor appended bottles containing (fruit) concentrates are needed. In one single action, by pressing one button on the beverage dispenser of the invention, the consumer receives a ready to drink beverage that is well-mixed, with an optimal taste, as the dispenser supplies the correct amount of water and concentrate to make a beverage having the right composition. The beverage dispenser of the present invention makes use of the facilities of the water cooler, hence no additional cooling machine and cold water supply are required, and additionally no extra floor space is needed for the beverage dispenser. Due to the design of the dispenser, the beverage dispenser can have minimal cleaning requirements, making it a hygienic device. The beverage dispenser does not need a mixing chamber where the water and concentrate are mixed. Usually such a mixing chamber needs daily cleaning, which is not needed for the present invention. Concentrate from a container in the beverage dispenser and water from the water cooler can each be connected to dedicated nozzles, pump heads and conduits. Jets of water and concentrate flowing from the nozzles can be mixed in air when dispensing a beverage. This all can lead to prevention of contamination of parts of the beverage dispenser. A cup that is standing underneath the mixing point of the jets, can be filled with the ready-to-drink beverage, after mixing the concentrate with water.

Definitions

The following terms have the following meaning in the context of the present invention.

Beverage dispenser: a device to be used in combination with a water cooler, wherein the water cooler comprises a cooling device and a water bottle, and the beverage dispenser is intended to be positioned between the cooling device and the water bottle, and the beverage dispenser comprises a dispensing station whereat a beverage other than water may be dispensed. The preferred beverage dispensers are those adapted to be removeably positioned between the device and the water bottle, wherein "removeably" means that the dispenser may be positioned and removed without affecting the normal operation of the water cooler.

Water cooler: a device that can cool and dispense water, and that can contain a water bottle and a cooler housing upon which the water bottle is put upside down.

Cooler housing: a structural element that supports a water bottle and forms the base of the water cooler, contains a cooling device and comprises a reservoir containing cold water, and which may also optionally comprise taps to dispense water.

Cooling device: a device that cools the water from the bottle, located in the cooler housing, typically towards the bottom thereof.

Conversion set: provides means to fit a beverage dispenser to different types, configurations, and brands of water coolers and cooler housings.

Dispensing station: a station at a beverage dispenser or water cooler where a receptacle (such as a disposable cup) can be placed or held whilst a beverage is dosed therein.

Concentrate: a beverage precursor which can be diluted with water to provide a palatable beverage. Typically the concentrate will have a solids content of at least 3% by weight, more preferably at least 10% by weight, more preferably still at least 15% by weight and most preferably from 20 to 80% by weight. Within the context of this application concentrate encompasses beverage precursors like fruit juice concentrates, syrups (a thick, viscous liquid, containing a large amount of dissolved sugars and the like) and the like. Moreover the invention also encompasses the possibility to use diluents other than water, e.g. alcoholic drinks, milk, or any other consumable liquid.

Tea: material derived material from *Camellia sinensis* var. *sinensis* or *Camellia sinensis* var. *assamica*. It also includes rooibos tea obtained from *Aspalathus linearis*. "Tea" is also intended to include the product of blending two or more of any of these materials. A "tea-based" concentrate is one which comprises solids derived from tea. Typically a tea-based concentrate will comprise at least 0.5% by weight tea solids, more preferably at least 1% and most preferably from 3 to 50%.

DESCRIPTION OF THE DRAWINGS

The invention is illustrated by the drawings, in which.

WATER COOLER AND BEVERAGE DISPENSER

Figure 1:
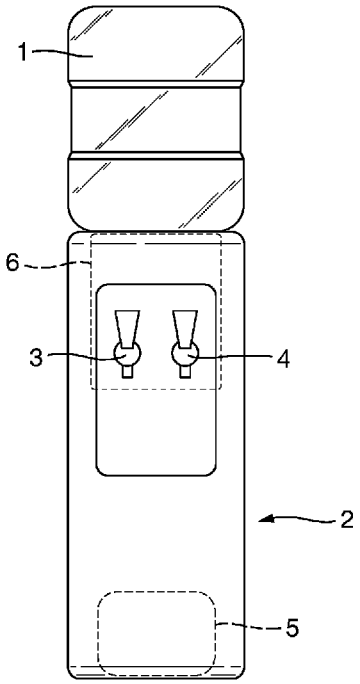
FIG. 1 shows a schematic drawing of a water cooler.

The water cooler as illustrated in FIG. 1 is a conventional water cooler, as can be found in many offices and work places world wide. The illustrated water cooler comprises a water bottle (1) and a cooler housing (2), upon which the water bottle (1) is seated upside down (i.e. with the opening of the bottle at the bottom thereof). The volume of the water bottle (1) can be, for example, up to about 20 liters. The cooler housing (2) can be regarded to be a cylinder (or box or any other shape) that usually contains a cooling device (5) on the bottom and a reservoir (6) containing cold water. Generally the cooling device (5) on the bottom and a reservoir (6) are not visible from the outside. Water flows through conduits from bottle (1) through cooling device (5), to cold water reservoir (6). Cups can be filled with water using water taps (3) and (4) for cold water and ambient water, respectively. The water from cold water tap (3) is supplied from reservoir (6), while the water from tap (4) is not cooled and is supplied from bottle (1) directly. Some water coolers can, in addition to cold and ambient water, also supply heated water. In that case, the cooler housing will also comprise a heating system for water, and a warm water reservoir. FIG. 1 does not indicate conduits, connectors, and valves between the different elements of the water cooler. These parts would be apparent for a person skilled in the art.

Figure 2:
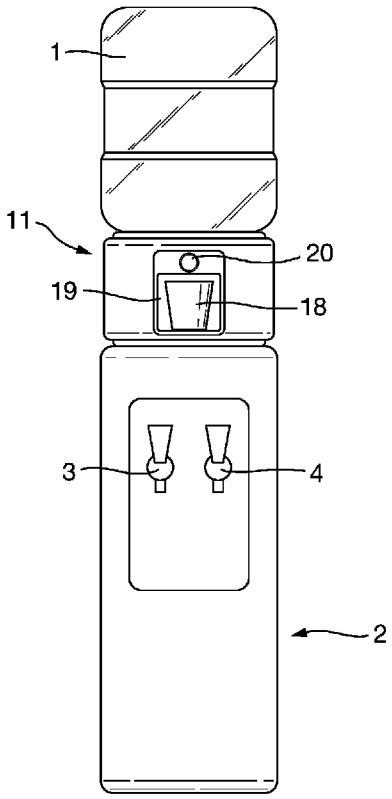
FIG. 2 shows a schematic drawing of the water cooler of FIG. 1 but modified with an embodiment of the beverage dispenser according to the invention.

A preferred embodiment of the current invention is illustrated in FIG. 2: a beverage dispenser (11) that is fitted to an existing water cooler. The beverage dispenser is positioned on the cooler housing (2), and the water bottle (1) is put upside down on top of the beverage dispenser (11). The beverage dispenser (11) is fitted to the cooler housing by means of a conversion set. Using such a conversion set, conduits and other parts can be fitted between the beverage dispenser and water cooler. The conversion set comprises means to fit the beverage dispenser to different types, configurations, and brands of water coolers and cooler housings.

Figure 5:
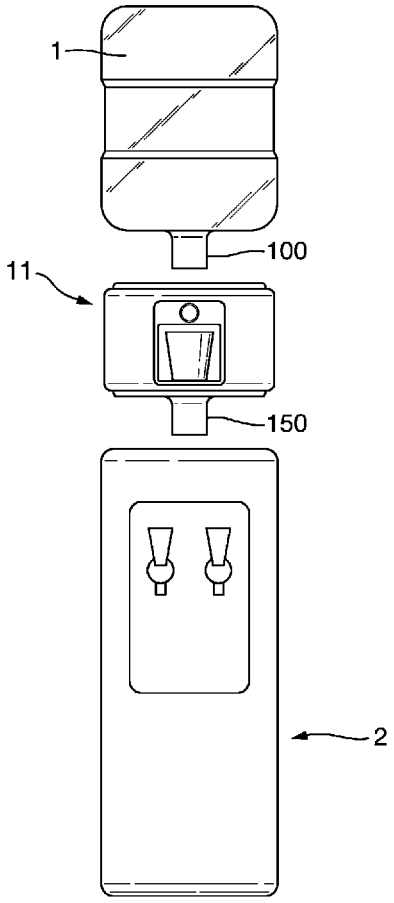
FIG. 5 shows the components of the modified water cooler of FIG. 2 before assembly.

A more detailed understanding of the relationship between the bottle (1), dispenser (11) and housing (2) of the modified water cooler shown in FIG. 2 can be appreciated from FIG. 5. In this embodiment the water bottle (1) comprises a neck (100) and the cooler housing (2) comprises a recess (not shown) in the top surface thereof which is shaped to receive the neck (100) of the water bottle (1) and sealingly engage therewith. The beverage dispenser (11) in the embodiment illustrated in FIG. 5 has a protrusion (150) on the bottom surface thereof and a recess (not shown) on the top surface thereof. The protrusion (150) is shaped to mimic exactly the form and dimensions of the bottle neck (100) such that the protrusion (150) can be received in and form a sealing fit with the housing recess. Similarly, the dispenser recess is shaped to mimic exactly the form and dimensions of the housing recess such that the dispenser recess can receive and form a sealing fit with the bottle neck (100).

Although the modified water cooler illustrated in FIG. 2 comprises a single beverage dispenser (11), the water cooler may comprise 1 to 4 beverage dispensers according to the invention that are positioned between the cooling device and the water bottle. Two or more beverage dispensers (11) may be fitted to a water cooler, therewith providing the consumer a larger choice of beverages, without the need of extra floor space or an additional cooling machine or water supply. The beverage dispensers may be designed in such a way that one dispenser can be regarded as a ring or cylinder. The beverage dispensers can be stacked, and a second beverage dispenser can be put upon the first dispenser, and the water bottle is then put upon the second dispenser. The number of beverage dispensers per water cooler is limited by the height at which it is still practical to take a cup of beverage from the dispenser, and to which it is practical to replace the water bottle. Preferably the number of additional beverage dispensers per water cooler is between 1 and 3, more preferred 1 or 2. Another possibility is that a beverage dispenser is designed and constructed in the form of a wedge, and that for example 2 to 4 wedges together form a ring or cylinder. Each of the beverage dispensers in the shape of a wedge then contains the elements according to the invention, as will be described below. In all of these cases (beverage dispensers which are stacked or in the form of wedges), the conversion set will be designed in such a way that water can be supplied from the water cooler to each of the beverage dispensers.

The beverage dispenser may be suitable to be used in conjunction with existing conventional water coolers, and the beverage dispenser can easily be fitted to the cooler housing using the conversion set. In addition, the present invention also encompasses a beverage dispenser that is integrated in the cooler housing, therewith forming an inseparable cooler housing and beverage dispenser. The beverage dispenser and water cooler then have the same characterising elements as in the case when a beverage dispenser is put on top of an existing cooler housing. Also in this case one or more beverage dispensers may be put on top of the existing cooler housing with integrated beverage dispenser. Therefore another aspect of the present invention is a water cooler, wherein at least one beverage dispenser according to the invention is integrated with the cooler housing, and wherein the dispensing station is comprised by the cooler housing. Preferably said water cooler, wherein at least one beverage dispenser according to the invention is integrated with the cooler housing, may comprise 1 to 4 beverage dispensers according to the invention that are positioned between the cooling device and the water bottle.

The beverage dispenser is illustrated in FIG. 2 with a receptacle (18) positioned at a dispensing station (19) ready for receiving a dose of beverage which is dispensed on actuation of the button (20). The receptacle (18) for use with the dispenser of the present invention may be any suitable beverage holder and is preferable a cup, especially a disposable cup.

Figure 3:
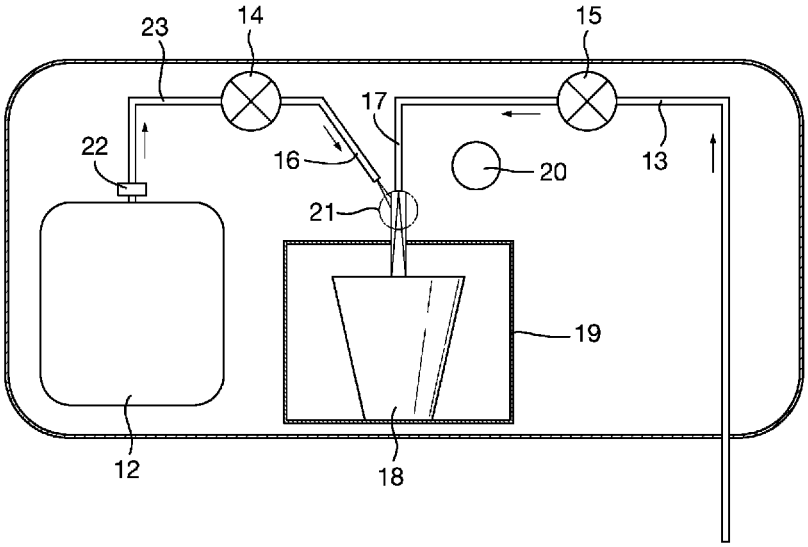
FIG. 3 shows a schematic drawing of parts of a beverage dispenser according to the invention.

The beverage dispenser according to the invention preferably comprises at least one container containing a concentrate, more preferably two or more containers containing concentrate. In the embodiment that is schematically illustrated in FIG. 3, the beverage dispenser (11) comprises a container (12) wherein beverage concentrate is contained. The container (12) could be any container which is conventionally used for storage of food-grade fluids, for example a bottle. Usually the volume of a container is 0.5 to 2 liters, although the container can have any volume, as long as the container fits in the dispenser. Preferably at least one of the containers is a single-use plastic bag.

A beverage dispenser according to the invention comprises a connector for attachment to a container comprising concentrate. As illustrated in FIG. 3 the container (12) is in fluid communication with a conduit (23) for supply of concentrate from the container (12) to a dedicated concentrate nozzle (16). The conduit (23) is attached to the container (12) using a connector (22). The connector (22) may comprise any suitable mechanism to connect a container to the beverage dispenser, and this mechanism is adapted to the type of closure of the container (12). The concentrate is pumped through the concentrate conduit (23) by means of a first pump head (14).

Water may be supplied directly from the water bottle or from a supply in the cooler housing. Preferably, a conduit (13) for supply of water is arranged to be in fluid communication with water in the water cooler. In the embodiment illustrated in FIG. 3, the conduit (13) supplies cold water from the cold water reservoir (6) in the cooler housing (2), and the flow is controlled by a second pump head (15). In case that the water cooler is equipped with a warm water supply and a warm water reservoir, then the water conduit (13) may be connected to the warm water reservoir by means of the conversion set.

Pump heads (14) and (15) may be driven by a single dual-head pump, or by two separate pumps each with one pump head. On actuation of button (20), the pump heads (14, 15) are started simultaneously, and a preset amount of concentrate flows out of the concentrate nozzle (16) as a jet into air and a preset amount of water flows out of the water nozzle (17) as a jet into air. The nozzles (16) and (17) are oriented such that the two jets are mixed at a common intersection point (21), before falling as the mixed beverage into a receptacle (18), standing in dispensing station (19).

Figure 4:
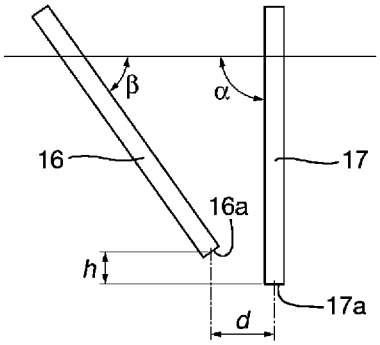
FIG. 4 shows an enlargement of the nozzles of the beverage dispenser of FIG. 3.

The relative position of the nozzles (16) and (17) is optimised in order to obtain good mixing, while preventing splashing of beverage and therewith avoiding extra cleaning requirements. The positioning of the nozzles is illustrated with reference to FIG. 4. The angle ($\alpha$) of the water nozzle (17) relative to the horizontal is between 45° and 90°, preferably between 75° and 90°, most preferably about 90°, meaning that most preferably the nozzle (17) is vertical or nearly vertical. The angle ($\beta$) of the concentrate nozzle (16) relative to the horizontal is between 25° and 90°, preferably between 45° and 75°, most preferably between 50° and 60°. It is especially preferred that the angle ($\alpha$) of the water nozzle is greater than the angle ($\beta$) of the concentrate nozzle. To ensure that the nozzles are arranged such that water dispensed from the water nozzle and concentrate dispensed from the concentrate nozzle intersect, their arrangement is preferably such that they are present in the same vertical plane.

Preferably the diameter of the concentrate nozzle (16) is chosen smaller than the water nozzle (17) to create a high velocity out of the concentrate nozzle (16) and so being able to accurately direct the concentrate jet at the water jet. The internal diameter of the water nozzle (17) is preferably between 2 and 15 mm, more preferably between 4 and 10 mm. The internal diameter of the concentrate nozzle is preferably between 0.5 and 10 mm, more preferably between 1 and 5 mm.

The nozzles (16, 17) each have a dispensing opening (16*a*, 17*a*) and the horizontal and vertical distances between the centres of the openings of concentrate nozzle (16*a*) and water nozzle (17*a*) may also be optimised to prevent splashing. Preferably the horizontal distance (d) between the centres of the openings (16*a*, 17*a*) is between 5 and 20 mm, more preferably between 5 and 15 mm. The vertical distance (h) between the centres of the openings (16*a*, 17*a*) is preferably between 0 and 20 mm, more preferably between 0 and 10 mm. Preferably also, the opening (16*a*) of the concentrate nozzle (16) is positioned higher than the opening (17*a*) of the water nozzle (17).

In a preferred embodiment the beverage dispenser comprises two or more containers containing concentrate. Two or more containers, filled with different concentrates, connected with pump heads, conduits and nozzles, can be present in the beverage dispenser, to give the consumer more choice than only a cup of water from the water cooler and one beverage from the dispenser. Preferably each container (12) is connected to a dedicated pump head (14) a dedicated conduit (23) and dedicated concentrate nozzle (16). Also preferably the conduit (13) for supply of water from the water cooler is connected to a dedicated pump head (15) and a dedicated water nozzle (17). Each container can be connected to dedicated pump heads, conduits and nozzles, analogous to the first container (12), in order to prevent cross-contamination between different concentrate flavours. Consequently, the number of buttons (20) on the beverage dispenser is preferably at least equal to the number of containers in the beverage dispenser. The number of containers is limited by the space available within the beverage dispenser, and is preferably from 1 to 4, most preferred the number of containers is 2. Where a plurality of containers may be employed then the dispenser will comprise a plurality of connectors (22). Thus in a preferred embodiment the dispenser comprises at least two connectors, wherein each connector is for attachment to a container comprising concentrate. More preferably the dispenser comprises from 2 to 4 connectors.

To ensure a constant mix ratio of water and concentrate, pump heads (14, 15) are preferably used for both liquids so as to be independent of gravity's influence on flow speed. In order to facilitate mixing, the pump heads can operate in a constant flow mode, or in a pulsating flow mode while dispensing water and concentrate. Positive displacement pumps and peristaltic pumps can be applied, where the peristaltic pumps are most suitable for pulsating flow. Preferably the water flow is operated in a constant flow mode, while the concentrate flow is operated in a constant or pulsating flow mode. Most preferably both concentrate pump head (14) and water pump head (15) operate in constant flow mode when beverage is dispensed.

The volumes that pump heads (14) and (15) discharge are based on the required dilution ratio and required total beverage volume, and can be adjusted by an operator. Preferably the concentrate is a tea-based concentrate, from which a fresh and cool ready to drink ice tea beverage can be made after dilution with water. Preferably at least one of the containers (12) contains a tea-based concentrate. If more than one container (12) is present, possibly the first concentrate is a regular ice tea concentrate, while a second concentrate may be any concentrate to be diluted to make a beverage. Examples of this are fruit juice concentrates, or lemonade syrups, and they may be sweetened using regular sweeteners like sugar, or non- or low-caloric sweeteners like aspartame or sucralose. The required dilution rate is dependent on the strength of the concentrate. The dilution ratio of concentrate to water is preferably between 1:1 and 1:20 (by volume), more preferably between 1:1 and 1:10 (by volume). The total volume of the dispensed beverage can be adjusted, and is preferably between 100 and 300 milliliters, more preferably between 150 and 250 milliliters per serving.

It should be noted that parts of the beverage dispenser like conduits, connectors, valves and an electronic control unit are not all indicated in the drawings. The omitted parts have been left out for clarity but these parts would be apparent to the person skilled in the art.

EXAMPLE

The following non-limiting example illustrates the present invention.

A beverage dispenser (11) as schematically indicated in FIG. 3 was manufactured and fitted between the cooler housing (2) and the water bottle (1) of a conventional water cooler (as illustrated in FIG. 2). The height of the beverage dispenser was 20 cm, and the diameter was equal to that of the cooler housing. Water was pumped from the cold water reservoir (6) in the cooler housing by a centrifugal pump and pump head (15)—the flow speed was regulated by a combination of the outlet diameter of conduit (13) and a valve restricting the water flow (not indicated in FIG. 3) at the inlet side. A 1 liter plastic bag (12) containing LiptonTM Ice Tea syrup (Lipton Ice Tea Post-Mix syrup, dilution ratio 1:8, supplied by Unilever) was connected to a centrifugal pump and pump head (14). The conduits were equipped with a valve restricting the water flow and non-return valve (not indicated in FIG. 3). Diameters of the nozzles (16) and (17) and pump heads (14) and (15) for concentrate and water were optimized to create a flow of 200 mL in 10 seconds. With a dilution ratio of 1:8 this resulted in flow rates of 133 mL/min for concentrate, and 1064 mL/min for water. The diameter of the water nozzle was 6 mm, while the diameter of the concentrate nozzle was 1 mm.

Various arrangements of relative positions of water nozzle (17) and concentrate nozzle (16) were tested, see table 1, wherein the horizontal (d) and vertical (h) distances between the centre of the nozzle openings (16*a*, 17*a*) were varied, as well as the angles (α, β) of the nozzles relative to horizontal. In all cases the arrangement of the nozzles was such that they were positioned in such a way that openings (16*a*, 17*a*) were present in the same vertical plane.

Table 1 Results of variation of the arrangement of the nozzles (16) and (17) on quality of dispensing.

TABLE 1

| # | d (mm) | h (mm) | α | β | flow | result |
|---|---|---|---|---|---|---|
| 1 | 7 | 0 | 50° | 90° | pulsating water, pulsating concentrate | spattering |
| 2 | 7 | 0 | 50° | 90° | constant water, pulsating concentrate | good mixing, drops on water nozzle |
| 3 | 7 | 9 | 60° | 80° | constant water, pulsating concentrate | good mixing |
| 4 | 3 | 2 | 60° | 80° | constant water, pulsating concentrate | good mixing, but concentrate spattering on water nozzle |
| 5 | 8 | 4 | 90° | 55° | constant water, pulsating concentrate | good mixing, no spattering |
| 6 | 8 | 4 | 90° | 55° | constant water, constant concentrate | good mixing, no spattering |

d: horizontal distance between centres of nozzle openings h: vertical distance between centres of nozzle openings (wherein concentrate nozzle is positioned higher than the water nozzle)

α: angle of water nozzle compared to the horizontal (90° is vertical)

β: angle of concentrate nozzle compared to the horizontal (90° is vertical)

Configurations 5 and 6 were the configurations which were best practical application in a beverage dispenser according to the invention.

The invention claimed is:

1. A beverage dispenser for use in combination with a water cooler, wherein the water cooler comprises a cooling device and a water bottle, and the beverage dispenser is intended to be positioned between the cooling device and the water bottle, wherein the beverage dispenser comprises:

a dispensing station where a receptacle can be placed or held whilst a beverage is dosed therein, a dedicated water nozzle for dispensing water at the dispensing station, a conduit for supply of water from the water cooler to the water nozzle, a dedicated pump head for pumping water from the cooler to the water nozzle;

a connector for attachment to a container comprising concentrate, a dedicated pump head for concentrate from the container to the concentrate nozzle;

a dedicated concentrate nozzle for dispensing concentrate at the dispensing station, a conduit for supply of concentrate from the container to the concentrate nozzle;

wherein the water nozzle and the concentrate nozzle are arranged such that a jet of water dispensed from the water nozzle and a jet of concentrate dispensed from the concentrate nozzle intersect and mix in air before contacting said receptacle, and wherein the angle (β) of the concentrate nozzle relative to the horizontal is 45° to 75°, and the angle (α) of the water nozzle relative to the horizontal is 75° to 90°; and wherein said angle (α) of the water nozzle is greater than said angle (β) of the concentrate nozzle;

wherein each of the water nozzle and the concentrate nozzle has a dispensing opening and the horizontal distance (d) between the centers of the openings of the concentrate nozzle and the water nozzle is between 5 and 20 mm; and wherein the beverage dispenser does not comprise a mixing chamber.

2. The beverage dispenser as claimed in claim 1, wherein the vertical distance between the centres of the openings of the concentrate nozzle and the water nozzle is between 0 and 20 mm.

3. The beverage dispenser as claimed in claim 1, wherein the internal diameter of the water nozzle is between 2 and 15 mm, and the internal diameter of the concentrate nozzle is between 0.5 and 10 mm.

4. The beverage dispenser as claimed in claim 1, wherein the beverage dispenser comprises at least one container containing concentrate.

5. The beverage dispenser as claimed in claim 4, wherein at least one of the containers contains a tea-based concentrate.

* * * * *